US005773385A

United States Patent [19]

Katoh et al.

[11] Patent Number: 5,773,385

[45] Date of Patent: Jun. 30, 1998

[54] THERMOSENSITIVE RECORDING MEDIUM

[75] Inventors: Yoshinori Katoh; Takanori Motosugi, both of Numazu, Japan

[73] Assignee: Ricoh Co., Ltd., Tokyo, Japan

[21] Appl. No.: 614,968

[22] Filed: Mar. 11, 1996

[30] Foreign Application Priority Data

Mar. 10, 1995 [JP] Japan ..... 7-078446

[51] Int. Cl.[6] ..... B41M 5/40

[52] U.S. Cl. ..... 503/200; 427/150; 427/151; 427/152; 503/226

[58] Field of Search ..... 427/152, 150, 427/151; 503/200, 226

[56] References Cited

FOREIGN PATENT DOCUMENTS

| | | | |
|---|---|---|---|
| 43 4160 | 2/1943 | Japan . | |
| 45-14039 | 5/1970 | Japan . | |
| 000 5093 | 1/1984 | Japan | 503/226 |
| 024 8390 | 12/1985 | Japan | 503/226 |
| 2-15376 | 1/1990 | Japan . | |
| 2175278 | 7/1990 | Japan | 503/226 |

*Primary Examiner*—Bruce H. Hess

*Attorney, Agent, or Firm*—Oblon, Spivak, McClelland, Maier & Neustadt, P.C.

[57] ABSTRACT

A thermosensitive recording medium, having a support, an intermediate layer disposed thereon, and a thermal recording layer disposed on the intermediate layer, with the support being a plastic film or a synthetic paper having a thickness of less than or equal to 150 $\mu$m, and the intermediate layer containing hollow particles having a volume ratio of hollow particle to total intermediate layer material of greater than or equal to 20% and having a thermal conductivity of the intermediate layer together with the support of less than or equal to 0.55 kcal/mh°C. is provided which has improved properties such as reduced paper curl, excellent dot print reproducibility and sufficient adhesion between layers, and which is conveniently used in a wide variety of information recording applications.

12 Claims, 1 Drawing Sheet

AB: MACHINE DIRECTION
CD: CROSS DIRECTION
DISTANCE ARE IN MM.

AB: MACHINE DIRECTION
CD: CROSS DIRECTION
DISTANCE ARE IN MM.

THERMOSENSITIVE RECORDING MEDIUM

BACKGROUND OF THE INVENTION

1. Field of the Invention

The present invention relates to a thermosensitive recording medium having a support, an intermediate layer and a recording layer, and uses a coloring reaction of a coloring material with a color developer, being colorless or light colored at room temperature and becoming colored by heating.

2. Discussion of the Background

A variety of information recording media have been developed to comply with the demands for expanding and diversifying the volume of information and yet conserving resources and reducing environmental problems.

A thermosensitive recording medium has an advantage over other conventional recording media for the following reasons; (1) color images on the medium can be obtained only by heating without complicated steps such as development and fixing, (2) the medium can be produced with relatively simple and compact apparatus, is handled with ease and is low in maintenance cost; and (3) since it often uses paper as the support, the medium is not only inexpensive in its substrate cost but also has a resemblance to plain paper when used as data output sheets.

The thermosensitive recording medium is, therefore, employed in a number of fields, such as print outputs for computers, medical measurement instruments, high speed facsimiles, automatic vending machines of labels and tickets, video printers and photocopying machines. In addition, the medium has recently become widely used in the fields of CAD, outputting detailed drawings carrying finer picture images in compliance with increased requirements for higher reproducibility of thin lines.

The thermosensitive recording medium is generally produced by forming a thermosensitive recording layer on a support such as a sheet of plain paper, synthetic paper or plastic film. The coloring layer is prepared by spreading and drying a liquid consisting essentially of a thermosensitive component, which is capable of inducing a color by the application of heat.

The above-mentioned thermosensitive medium is capable of recording images by heating with a thermal pen or a thermal printhead, for example. Although such thermosensitive media are exemplified by those disclosed by Japanese Pat. Nos. 4160/1968 and 14039/1970, those media have shortcomings, such as low heat response resulting in insufficient color density for high speed recording.

There has also been a demand for more durable thermosensitive recording media having improved sheet strength by replacing conventional plain papers by plastic films, synthetic papers and others. This replacement has raised new problems, such as more frequent electric charging, lower adhesion between the support and the overlying layer, and shrinkage of the plastic films or synthetic paper by heat from the thermal printhead.

The above-mentioned heat shrinkage tends to appear on the surface of the films or papers in contact with the printhead. The shrinkage appears at the side of the films towards the printhead and leaves the other side relatively unchanged, resulting in paper curl. This shrinkage may degrade quality of the printout, despite the use of rather expensive plastic films or synthetic papers to promote the quality.

Also for the above-noted CAD applications in which the size stability of the output print is quite important, heat shrinkage by the printhead causes difficulty by shortening the output images.

The plastic films and synthetic papers, in general, have a relatively high rate of length change by heat. Although films of synthetic polymer, such as polyethylene or polypropylene are less expensive than polyester, these films have relatively high rates of shrinkage, resulting in paper curl by the thermal printhead.

One suggestion for preventing paper curl has already been made in Japanese Design Pat. Application No. 15376/1990, which proposed a layer of foamed plastics between a support and a thermosensitive coloring layer with increased adhesion between layers due to the rough surface of the foamed plastics layer. This method, however, tends to roughen the surface of the coloring layer as well, causing poor dot print reproducibility even after a calender treatment.

Also, for the CAD application, it is of primary importance to be able to print thin lines. Although the thin lines along the thermal printhead are printed with sufficient color density due to heat stored in the printhead, transverse thin lines tend to be blurred. In video printer applications, where picture images are more frequently output than in CAD applications, an improvement in dot reproducibility is also preferable.

Also, output sheets can be handled in many ways, such as being placed on a board or rolled up for carry with an adhesive tape, which might result in missing dots by peeling coated layers off from the support when the adhesive tape is taken off.

SUMMARY OF THE INVENTION

Accordingly, one object of the present invention is to provide a thermosensitive recording medium which overcomes the above-mentioned difficulties.

A further object of the present invention is to provide a thermosensitive recording medium with reduced paper curl, excellent dot print reproducibility and sufficient adhesion between layers, which can be readily used in a variety of areas of information recording.

These and other objects of the present invention have been satisfied by the discovery of a thermosensitive recording medium comprising a support, an intermediate layer disposed thereon and a thermosensitive recording layer further thereon, wherein the support comprises a plastic film or a synthetic paper having a thickness of less than or equal to 150 $\mu$m and the intermediate layer contains hollow particles with a volume ratio, of the hollow particles to the layer material, of greater than or equal to 20% and with a thermal conductivity, of the intermediate layer together with the support, of less than or equal to 0.55 kcal/mh°C.

These and other objects, features and advantages of the present invention will become more apparent upon a consideration of the following description of the preferred embodiments of the present invention taken in conjunction with the accompanying drawing.

DESCRIPTION OF THE PREFERRED EMBODIMENTS

Figure 1:
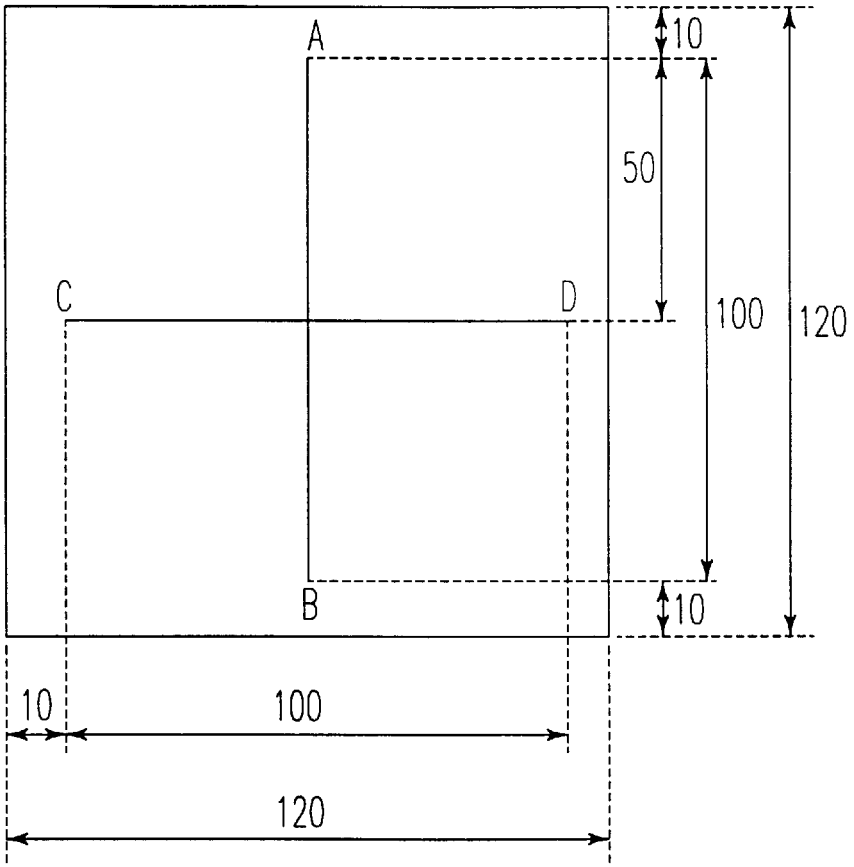
FIGURE 1 is a top view of a test piece of the thermosensitive recording medium, indicating size and measurement points.

In the detailed description which follows, embodiments of the invention which are particularly useful in the information recording applications are described. It is understood, however, that the invention is not limited to these embodiments. For example, it is appreciated that the medium and methods of the invention are adaptable to any form of information recording. Other embodiments will be apparent to those skilled in the art.

The invention provides an improved thermosensitive recording medium, comprising a support, an intermediate layer disposed thereon and a thermosensitive recording layer further thereon, wherein the support comprises a plastic film or a synthetic paper having a thickness of less than or equal to 150 μm and the intermediate layer contains hollow particles with a volume ratio, of the hollow particles to the layer material, of greater than or equal to 20% and with a thermal conductivity, of the intermediate layer together with the support, of less than or equal to 0.55 kcal/mh°C.

According to an alternative embodiment, the plastic film or the synthetic paper has a heat shrinkage rate of greater than or equal to 0.5% at 100° C. along the machine direction or the cross direction, measured as defined by JIS K-6734.

In another embodiment, the hollow particles have hollows of an average diameter of less than or equal to 20 μm.

In yet another embodiment, the amount of binder used is required to satisfy the relation:

$W_r \div V\ \% \times 100 \geqq 0.3$, wherein $W_r$ is the weight ratio of binder to hollow particles on a dry basis and V % is the volume % of hollows in particles.

The intermediate layer of the present invention contains minute hollow particles which are small enough in average diameter to provide the intermediate layer with a smooth surface. This also gives rise to a smooth surface of the coloring layer which is coated thereon and subsequently calender treated thereto, resulting in excellent dot print reproducibility.

Conventional wisdom in the art would predict that inclusion of such materials as the hollow particles may cause poor adhesion between layers. In the present invention, however, the layer adhesion is also improved by determining the proper amount of binders included in the intermediate layer. In addition, by employing such an intermediate layer, heat dissipation from the thermal printhead to the support is reduced, enabling the use of relatively expensive and less heat resistant polyethylene or polypropylene as the support with yet improved paper curl and size stability characteristics.

In conventional thermosensitive recording medium, the support generally has a thickness of from 50 to 150 μm. As the thickness gets smaller, the support tends to be affected more by the heat of the thermal printhead with a larger rate of heat shrinkage. Since plastic films or synthetic papers with a thickness of less than 150 μm are used for the support in the present invention, a rather large paper curl would be expected using these materials alone. It was found that the paper curl is considerably reduced and the size stability increased by including hollow particles with a volume ratio, of the hollow particles to the layer material, of greater than or equal to 20% and with a thermal conductivity, of the intermediate layer together with the support, of less than or equal to 0.55 kcal/mh°C.

The thickness of the support is generally less than 150 μm, preferably from 50 to 100 μm. A thickness of more than 150 μm was found to reduce the desirable features in the present invention because of a rather excessive flexural rigidity of the support. Also for a thickness of less than 50 μm, sufficient improvement can not be achieved even with the provision of the intermediate layer.

The rate of heat shrinkage and its method of measurement are defined by Japanese Industrial Standard (JIS) K-6734 as follows. As the heating tester, a gear-type aging tester or its equivalent is used which can maintain temperature from 80° C. to 120° C. within 2° C. and, as a scale, a slide caliper defined by JIS B-7505 is used. As shown in FIGURE 1, the test pieces of the thermosensitive recording medium are prepared from a large sheet by measuring off two square pieces of 120 mm long on each side. These two pieces are placed horizontally for 10 minutes in the heating tester at a maintained temperature of 100° C. and subsequently cooled to room temperature. On these two pieces, measurements are carried out between measurement points along the machine direction A and B in FIGURE 1 which are placed 10 mm inside from the top and bottom edge of the test piece and between points C and D along the cross direction also in the FIGURE 1 which are placed likewise from the left and right side edge. The measured values for the two pieces are averaged to obtain the rate of heat shrinkage, S, for each direction, using the relation $$S=(l_2-l_1)/l_1\times 100,$$

where $l_1$ and $l_2$ are the lengths before and after heating, respectively.

For hollow particles included in the intermediate layer, conventional hollow forming materials are used, such as glass, ceramics, or plastics. The volume ratio of hollows to the hollow particles employed in the present invention is greater than or equal to 20%. The effects of the inclusion increase with increasing volume ratio with a preferred volume ratio being greater than or equal to 50%. The increase in the volume ratio may cause a decrease in the amount of materials disposed as the intermediate layer. Without any of the hollow particles, the amount of materials disposed in the intermediate layer has to be greatly increased, which is not preferable from a practical point of view.

In order to prevent a decrease in adhesion of the intermediate layer, the amount of binders has to be increased as the volume ratio of the hollow particles increases. Excellent layer adhesion is most preferably realized by satisfying the relation;

$$W_r V\ \% \times 100 \geqq 0.3$$

wherein $W_r$ is the weight ratio of binder to hollow particles on a dry basis and V % is the volume % of hollows in particles. If the above value is less than 0.3, poor layer adhesion will result from an insufficient amount of binder.

Also in the present invention the preferred diameter of the hollow particles is less than 20 μm and, as the diameter decreases, a better result is obtained, such as in the dot print reproducibility.

In addition to the above-noted hollow particles, conventionally available fillers may also be added. Examples of these fillers include inorganic materials such as calcium carbonate, silica, zinc oxide, titanium oxide, aluminum hydroxide, magnesium hydroxide, barium sulfate, clay and talc and organic materials such as urea-formaldehyde resin, styrene-methacrylic acid copolymer and polystyrene resin.

In order to provide the intermediate layer according to the present invention, a variety of conventional binders can be employed. Specific examples of suitable binder agents include:

Water Soluble Polymers polyvinyl alcohol, starch and starch derivatives, cellulose derivatives, such as methoxycellulose, hydroxyethylcellulose, carboxymethylcellulose, methylcellulose, and ethylcellulose, sodium salts of polyacrylic acid, polyvinylpyrrolidone, acrylamide-acrylate copolymer, acrylamide-acrylate-methacrylic acid copolymer, alkali salts of styrene-maleic anhydride copolymer, alkali salts of isobutylene-maleic anhydride copolymer, polyacrylamide, sodium alginate, gelatin, and casein;

Latex Polymers polyvinyl acetate, polyurethane, styrene-butadiene copolymer, ethylene-vinyl acetate copolymer, and styrene-butadiene-acrylate copolymer.

In the thermosensitive coloring layer of the present invention, the coloring material is preferably a leuco dye, although with the use of the required intermediate layer of the present invention, other conventional coloring agents and coloring developer systems can be used. The leuco dyes may be used individually or plurally and any dye conventionally used in thermosensitive recording materials can be used. For example, triphenyl-methane type, fluoran-type, phenothiazine-type, auramine type, spiropyran-type and indorinophthalide-type leuco compounds are preferably used.

Specific examples of the leuco dyes include, but are not limited to:

3,3-bis(p-dimethylaminophenyl)phthalide, 3,3-bis(p-dimethylaminophenyl)-6-dimethylmaino-phthalide or Crystal violet Lactone, 3,3-bis(p-dimethylaminophenyl)-6-diethylamino-phthalide, 3,3-bis(p-dimethylaminophenyl)-6-chloro phthalide, 3,3-bis(p-dibuthylaminophenyl)phthalide, 3-cyclohexylamino-6-chlorofluoran, 3-dimethylamino-5-7-dimethylfluoran, 3-N-methyl-N-isobutyl-6-methyl-7-anilinofluoran, 3-N-ethyl-N-isobutyl-6-methyl-7-anilinofluoran, 3-diethylamino-7-chlorofluoran, 3-diethylamino-7-methylfluoran, 3-diethylamino-7,8-benzfluoran, 3-diethylamino-6-methyl-7-chlorofluoran, 3-(N-p-tolyl-ethylamino)-5-methyl-7-anilinofluoran, 3-pyrrolidino-6-methyl-7-anilinofluoran, 2-[N-(3'-trifluoromethylphenyl)amino]-6-diethylaminofluoran, 2-[3,6-bis(diethylamino)-9-(o-chloroanilino)xanthyl]-benzoic acid lactam, 3-diethylamino-6-methyl-7-(m-trichloromethylanilino)-fluoran, 3-diethylamino-7-(o-chloroanilino)fluoran, 3-dibutylamino-7-(o-chloroanilino)fluoran, 3-(N-methyl-N-amylamino-6-methyl-7-anilino-fluoran, 3-(N-methyl-N-cyclohexylamino-6-methyl-7-anilino-fluoran, 3-diethylamino-6-methyl-7-anilino-fluoran, 3-diethylamino-6-methyl-7-(2',4'-dimethylanilino)-fluoran, 3-(N,N-diethylamino)-5-methyl-7-(N,N-benzylamino)-fluoran, benzoyl leuco methylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'-chloro-5'-methylphenyl) phthalide, 3-morpholino-7-(N-propyl-trifluromethylanilino)fluoran, 3-pyrrolidino-7-trifluromethylanilino-fluoran, 3-diethylamino-5-chloro-7-(N-benzyl-trifluromethyl-anilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino) fluoran, 3-diethylamino-5-methyl-7-(α-phenylethylamino) fluoran, 3-diethylamino-7-piperidinofluoran, 2-chloro-3-(N-methyltoluidino)-7-(p-n-butylanilino) fluoran, 3-(N-methyl-N-isopropylamino)-6-methyl-7-anilino-fluoran, 3-dibutylamino-6-methyl-7-anilinofluoran, 3,6-bis(dimethylamino)fluorenespiro(9,3')-6'-dimethylaminophtalilde, 3-(benzyl-N-cyclohexylamino)-5,6-benzo-7-α-naphthyl-amino-4'-bromofluoran, 3-diethylamino-6-chloro-7-anilinofluoran, 3-N-ethyl-N-(2-ethoxypropyl)amino-6-methyl-7-anilino-fluoran, 3-N-ethyl-N-tetrafurfurylamino-6-methyl-7-anilino-fluoran, 3-diethylamino-6-methyl-7-mesidino-4',5'-benzofluoran, 3-(p-dimethylaminophenyl)-3-[1,1-bis(p-dimethylaminophenyl)ethylene-2-yl]phthalide, 3-(p-dimethylaminophenyl)-3-[1,1-bis(p-dimethylaminophenyl)ethylene-2-yl]-6-dimethylamino-phthalide, 3-(p-dimethylaminophenyl)-3-(1-p-dimethylaminophenyl-1-phenylethylene-2-yl) phthalide, 3-(p-dimethylaminophenyl)-3-(1-p-dimethylaminophenyl-1-p-chlorophenylethylene-2-yl) -dimethylaminophthalide, 3-(4'-dimethylamino-2'-methoxy)-3-(1"-p-dimethylaminophenyl-1"-p-chlorophenyl-1",3"-butadiene-4"-yl]benzophthalide, 3-(4'-dimethylamino-2'-benzyloxy)-3-(1"-p-dimethylaminophenyl-1"-p-chlorophenyl-1",3"-butadiene-4"-yl]-benzophthalide, 3-dimethylamino-6-dimethylamino-fluorene-9-spiro-3'(6'-dimethylamino)phthalide, 3-3-bis[2-(p-dimethylaminophenyl)-2-(p-methoxyphenyl)ethenyl-4,5,6,7-tetrachlorophthalide, 3-bis[1,1-bis(4-pyrrolidinophenyl)ethylene-2-yl]-5,6-dichloro-4,7-dibromophthalide, bis(p-dimethylaminostyryl)-1-naphthalenesulfonylmethane, and bis(p-dimethylaminostyryl)-1-p-tolyl-sulfonylmethane.

As the coloring developer for use in conjunction with the above mentioned leuco dyes, electron acceptors or oxidizing compounds can be employed, which induce color formation upon heat fusion with the leuco dyes. Phenol compounds, thiophenol compounds, thiourea derivatives or organic acids and their salts are preferably used.

Specific examples of the coloring developers include, but are not limited to:

4,4'-isopropylidenebisphenol, 4,4'-isopropylidenebis(o-methylphenol), 4,4'-sec-butylidenebisphenol, 4,4'-isopropylidenebis(2-tert-butylphenol), 4,4'-cyclohexylidenediphenol, 4,4'-isopropylidenebis(2-chlorophenol), 2,2'-methylenebis(4-methyl-6-tert-butylphenol), 4,4'-butylidenebis(6-tert-butyl-2-metylphenol), 1,1,3-tris(2-methyl-4-hydroxy-5-tert-butylphenyl)butane, 1,1,3-tris(2-methyl-4-hydroxy-5-cyclohexylphenyl)butane, 4,4'-thiobis(6-tert-butyl-2-methylphenol), 4,4'-diphenolsulfone, 4-isoproxy-4'-hydroxydiphenylsulfone, 4-benzyloxy-4'-hydroxydiphenylsulfone, 4-hydroxy-4'-isopropoxydiphenylsulfone, 4,4'-diphenolsulfoxide, isopropyl p-hydroxybenzoate, benzyl p-hydroxybenzoate, benzyl protocatechuate, stearyl gallate, lauryl gallate, octyl gallate, 1,7,bis(4-hydroxyphenylthio) -3,5-dioxaheptane, 1,5-bis(4-hydroxyphenylthio)-3-oxapentane, 1,3-bis(4-hydroxyphenylthio)propane, 1,3-bis(4-hydroxyphenylthio)-2-hydroxypropane, N,N'-diphenylthiourea, N,N'-di (m-chlorophenyl)thiourea, salicylanilide, 5-chloro-salicylanilide, 2-hydroxy-3-naphthoic acid, 2-hydroxy-1-naphthoic acid, 1-hydroxy-2-naphthoic acid, hydroxynaphthoic acid salts of metals such as Zn, Al or Ca, bis(4-hydroxyphenyl)methyl acetate, bis(4-hydroxyphenyl)benzyl acetate, 1,3-bis(4-hydroxycumyl)benzene, 1,4-bis(4-hydroxycumyl)benzene, 2,4'-diphenolsulfone, 3,3'-diallyl-4,4'-diphenolsulfone, α, α-bis (4-hydroxyphenyl)-α-methyltoluene, antipyrine complex of zinc thiocyanate, tetrabromobisphenol A, tetrabromobisphenol S, 4,4'-thiobis(2-methylphenol) and 4,4'-thiobis(2-chlorophenol).

A plurality of conventional binder agents can be employed for binding the above-mentioned leuco dyes and coloring developers onto a substrate of the thermosensitive recording medium of the present invention.

Specific examples of the binder agents include:

Water Soluble Polymers polyvinyl alcohol, starch and starch derivatives, cellulose derivatives such as hydroxymethycellulose, hydroxyethylcellulose, carboxymethylcellulose, methylcellulose, and ethylcellulose, sodium salts of polyacrylic acid, polyvinylpyrrolidone, acrylamide-acrylate copolymer, acrylamide-acrylate-methacrylic acid copolymer, alkali salts of styrene-maleic anhydride copolymer, alkali salts of isobutylene-maleic anhydride copolymer, polyacrylamide, sodium alginate, gelatin, and casein;

Emulsion Polymers polyvinyl acetate, polyurethane, polyacrylic acid, polyacrylate, vinyl chloride-vinyl acetate copolymer, polybuthylmethacrylate, and ethylene-vinyl acetate copolymer;

Latex Polymers styrene-butadiene copolymer, and styrene-butadiene-acrylate copolymer.

If desired, auxiliary components which are used in conventional thermosensitive recording materials, such as fillers, thermofusible materials, and surface active agents, can also be included in the thermosensitive coloring layer of the present invention.

Specific examples of suitable fillers are finely pulverized particles of inorganic fillers such as calcium carbonate, silica, zinc oxide, titanium dioxide, aluminum hydroxide, zinc hydroxide, barium sulfate, clay, talc, surface-treated calcium carbonate, surface-treated silica, and finely divided particles of organic fillers such as urea-formaldehyde resin, styrene-methacrylic acid copolymer, and polystyrene resin.

As sensitizers for the thermosensitive recording medium in the present invention, various thermofusible materials can be used. Specific examples of the thermofusible materials include, but are not limited to:

fatty acids, such as stearic acid and behenic acid, fatty acid amides, such as stearic acid amide and palmitic acid amide, metal stearates, such as zinc stearate, aluminum stearate, calcium stearate, zinc palmitate and zinc behenite, p-benzyl biphenyl, terphenyl, triphenyl methane, benzyl p-benzyloxybenzoate, β-phenyl naphthoate,
1-hydroxy-2-phenyl naphthoate,
1-hydroxy-2-methyl naphthoate,
diphenyl carbonate,
quaiacol carbonate,
dibenzyl terephthalate,
dimethyl terephthalate,
1,4-dimethoxynaphthalene,
1,4-diethoxynaphthalene,
1,4-dibenzyloxynaphthalene,
1,2-diphenoxyethane,
1,2-bis(3-methylphenoxy)ethane,
1,2-bis(4-methylphenoxy)ethane,
1,4-diphenoxy-2-butane,
1,4-diphenoxy-2-butene,
1,2-bis(4-methylphenylthio)ethane,
dibenzoylmethane,
1,4-diphenylthiobutane,
1,4-diphenylthio-2-butane,
1,3-bis(2-vinyloxyethoxy)benzene,
1,4-bis(2-vinyloxyethoxy)benzene,
p-(2-vinyloxyethoxy)biphenyl,
p-aryloxybiphenyl,
p-propargyloxybiphenyl
dibenzoyloxymethane,
dibenzoyloxypropane,
dibenzyldisulfide,
1,1-diphenylethanol,
1,1-diphenylpropanol,
p-benzyloxybenzylalcohol,
1,3-phenoxy-2-propanol,
N-octadecylcarbamoyl-p-methoxycarbonylbenzene,
N-octadecylcarbamoylbenzene,
1,2-bis(4-methoxyphenoxy)propane,
1,5-bis(4-methoxyphenoxy)-3-oxapentane,
dibenzyloxalate,
(4-methylbenzyl)oxalate, and
(4-chlorobenzyl)oxalate.

In addition to the intermediate and thermosensitive coloring layers, the support can be optionally coated with other conventional layers, such as a protective layer and/or a back lining layer.

Although it is desirable that the protective layer have a relatively large thickness to reduce heat shrinkage and also to protect output images from deterioration by chemicals, a small layer thickness is also preferable to provide high quality output for the above-noted CAD and video printer applications. The thickness of the protection layer is, therefore, a compromise, the value of which can be readily determined by one of ordinary skill in the art.

Since the support is usually made of plastic films and/or synthetic papers as noted above, electrically conductive materials may preferably be included in the back lining layer to prevent electrical charging, which can cause such troubles as electrostatic breakdown of the electron devices, paper jam and malfunction of paper stocking.

The thermosensitive recording medium of the present invention can be prepared by conventional methods, such as the following: one of the leuco dyes is mixed with a protective colloidal substance, such as polyvinyl alcohol, and one or more surfactants, and pulverized and dispersed by a grinding machine, such as a ball mill or a sand grinder. Coloring agents, binders and other additives are mixed and pulverized individually or plurally in a similar manner. A coloring layer coating liquid is prepared as prescribed, coated on the intermediate layer, then subsequently dried and calender treated.

In order to improve the conformity with a thermal pen or thermal printhead and also to improve the durability of recorded images, an overcoat layer may be provided on the coloring layer. This overcoat layer essentially contains the filler substances, surfactants and lubricants, for example.

In the foregoing embodiments mainly leuco-type dyes are described as the coloring materials for the thermosensitive recording medium. However, with the provision of the intermediate layer in the present invention, the coloring materials are not limited to the leuco dyes. For example, the combination of imino-compounds as coloring materials and aromatic isocyanate compounds as color developing materials may also be employed. As the imino-compounds there are included, but not limited to, 1,3-diimino-4,5,6,7-tetrachloroisoindoline, 3-imino-4,5,6,7-tetra chloroisoindoline-1-one and 1,3-di-iminoisoindoline.

Having generally described this invention, a further understanding can be obtained by reference to certain specific examples which are provided herein for purposes of illustration only and are not intended to be limiting. In the descriptions in the following examples, numerals are in weight ratio unless otherwise specified.

EXAMPLES

Example 1

A mixture of the following components was prepared by pulverizing and dispersing to obtain a coating liquid for an intermediate layer.

| | |
|---|---|
| Spherical plastic particles with hollows (volume ratio of hollows to particles 90%, average particle diameter 10 μm, and amount of solids 41%; R 24 from Matsumoto Yushi-Seiyaku Co, Osaka Japan) | 40 |
| Latex emulsion of styrene-butadiene copolymer (amount of solids of 42.5%; Polylac 750 from Mitsui-Toatsu Chemical CO, Tokyo, Japan) | 20 |
| Water | 60 |

A coating liquid for a thermosensitive coloring layer was prepared from the following solutions A and B by individually pulverizing and dispersing for 3 hours with a sand grinder and then mixing with stirring at a weight ratio of A:B of 1:5.

| | |
|---|---|
| Solution A: | |
| 3-butylamino-6-methyl-7-anilinofluoran | 20 |
| 10% polyvinylalcohol aqueous solution | 20 |
| water | 60 |
| Solution B | |
| 4-hydroxy-4'-isopropoxy-diphenylsulfone | 20 |

-continued

| | |
|---|---|
| Calcium carbonate | 10 |
| 10% polyvinylalcohol aqueous solution | 20 |
| Water | 50 |

A coating liquid for a protective layer was prepared by pulverizing and dispersing, with a ball mill, a mixture of the following components:

| | |
|---|---|
| Silica | 50 |
| 10% polyvinylalcohol aqueous solution | 500 |
| Zinc stearate | 50 |
| Water | 400 |

A sheet of polypropylene film, Yupo FPG 95 from Oji-Yuka Synthetic Paper Co, Tokyo, Japan with a thickness of 95 $\mu$m and a heat shrinkage rate of 1.4% along the machine direction was used as support. The intermediate layer coating liquid was coated thereon with a wire bar, in a coating amount of spherical plastic particles of 2 g/m$^2$ on a dry basis, and then dried. Onto the intermediate layer was coated the thermosensitive coloring layer coating liquid with a wire bar, in a coating amount of layer of 45 g/m$^2$ on a dry basis, and dried. Onto this layer the protective layer coating liquid was coated and dried in a similar manner in a coating amount of layer of 30 g/m$^2$ on a dry basis and subsequently calender treated to obtain a surface with Beck smoothness from 1000 to 3000 sec. Thus, a thermosensitive recording medium was formed.

Example 2

A thermosensitive recording medium was prepared in a similar manner to Example 1, except that the spherical plastic particles were replaced with HP-62 from Rohm and Haas, Tokyo, Japan with a volume ratio of hollows to particles of 30% and with an average particle diameter of 1 $\mu$m.

Example 3

A thermosensitive recording medium was prepared in a similar manner to Example 1, except that the amount of the binder in the intermediate layer was 5 wt %.

Comparative Example 1

A thermosensitive recording medium was prepared in a similar manner to Example 1, except that the spherical plastic particles with hollows in the intermediate layer were replaced with styrene-methacrylic acid copolymer.

Comparative Example 2

A thermosensitive recording medium was prepared in a similar manner to Example 1, except that an intermediate layer was not provided.

Comparative Example 3

A thermosensitive recording medium was prepared in a similar manner to Example 1, except that the coating amount of spherical particles in the intermediate layer was 0.5 g/m$^2$ on a dry basis and a thermal conductivity, of the intermediate layer together with the support, was 0.65 kcal/mh°C.

Each of the thermosensitive recording media prepared in Examples 1 through 3 and Comparative Examples 1 through 3 was subsequently subjected to the following tests and evaluations.

Printing tests were carried out with a commercially available printing test apparatus provided with a thin film thermal printhead from Matsushita Electronic Components Co, Osaka, Japan under the following conditions. On a sheet of the thermosensitive recording medium of 100 mm long and 50 mm wide, thermal dots were printed with a power of 0.45 W/dot, a pulse width of 1.0 msec, a printing time of 20 msec/line and a print line density of 8×3.85 dot/mm and such that the printed area on the sheet was vertically and laterally 90% of the full length. The height of induced paper curl was then measured with a JIS first class metal rule.

The induced color density was measured with a reflective densitometer Macbeth RD-0914. In addition, a checkered pattern was also printed on a test sheet with a Calcomp 52224 CAD plotter and paper width of each of the sheets with and without the printing was measured to obtain the values of paper size stability in %.

As a test of adhesion for intermediate layers, a piece of cellophane tape was placed on each of the sheets, and observations were made whether overlying layers were peeled off with the tape by a pulling force of the same degree of strength.

Measurements of the thermal conductivity were carried out with a thermal conductivity meter Kemtherm Q7M-03 from Kyoto Electronics Co, Kyoto, Japan.

The results are shown in TABLE 1.

| | Thermal conductivity | Curl height (mm) | Shrinkage (%) | Adhesion | Color density |
|---|---|---|---|---|---|
| EXAMPLE 1 | 0.40 | 2.0 | 0.08 | ○ | 1.43 |
| EXAMPLE 2 | 0.50 | 9.0 | 0.10 | ○ | 1.40 |
| EXAMPLE 3 | 0.43 | 3.0 | 0.08 | X | 1.41 |
| COMPARATIVE EXAMPLE 1 | 0.67 | 27.0 | 0.33 | ○ | 1.25 |
| COMPARATIVE EXAMPLE 2 | 0.81 | 31.0 | 0.49 | ○ | 1.18 |
| COMPARATIVE EXAMPLE 3 | 0.65 | 15.0 | 0.30 | ○ | 1.35 |

Adhesion
○: high and satisfactory
X: low and unsatisfactory

The results in Table 1 clearly indicate that the thermosensitive recording medium of the present invention exhibits such characteristics as a largely reduced paper curl, without heat shrinkage in the dot printed area and also with relatively high color density.

This application is based on Japanese Patent Application JP A 07-78446, filed with the Japanese Patent Office on Mar. 10, 1995, the entire contents of which are hereby incorporated by reference.

Obviously, additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A thermosensitive recording medium, comprising a support, an intermediate layer disposed thereon, and a thermal recording layer disposed on said intermediate layer, said support comprising a plastic film or a synthetic paper having a thickness of less than or equal to 150 $\mu$m, and said intermediate layer comprising hollow particles having a volume ratio of hollow particle to total intermediate layer material, of greater than or equal to 20% and having a thermal conductivity of said intermediate layer together with said support of less than or equal to 0.55 kcal/mh°C.

2. The thermosensitive recording medium of claim 1, wherein said plastic film or said synthetic paper has a heat shrinkage rate of greater than or equal to 0.5% at 100° C. along the machine direction or the cross direction or both, measured as defined by JIS K-6734.

3. The thermosensitive recording medium of claim 1, wherein said hollow particles have hollows of an average diameter of less than or equal to 20 $\mu$m.

4. The thermosensitive recording medium of claim 1, wherein said intermediate layer further comprises one or more binders in an amount sufficient to satisfy the relation:

$$W_r \div V\ \% \times 100 \geqq 0.3,$$

wherein $W_r$ is the weight ratio of binder to hollow particles on a dry basis and V % is the volume % of hollows in the hollow particles.

5. The thermosensitive recording medium of claim 1, further comprising a protective layer disposed on said thermal recording layer.

6. The thermosensitive recording medium of claim 1, further comprising an additional back coat layer disposed on a side of said support opposite the side having the intermediate and thermal recording layers.

7. A method of forming a thermal recording medium, comprising the steps of:

forming on a support, an intermediate layer containing hollow particles with a volume ratio of hollow particles to total intermediate layer material of greater than or equal to 20% and having a thermal conductivity of said intermediate layer together with said support of less than or equal to 0.55 kcal/mh°C., and forming on said intermediate layer a thermosensitive recording layer.

8. The method of claim 7, wherein said support is a plastic film or a synthetic paper having a heat shrinkage rate of greater than or equal to 0.5% at 100° C. along the machine direction or the cross direction or both, measured as defined by JIS K-6734.

9. The method of claim 7, wherein said hollow particles have hollows of an average diameter of less than or equal to 20 $\mu$m.

10. The method of claim 7, wherein said intermediate layer further comprises one or more binders in an amount sufficient to satisfy the relation:

$$W_r \div V\ \% \times 100 \geqq 0.3,$$

wherein $W_r$ is the weight ratio of binder to hollow particles on a dry basis and V % is the volume % of hollows in the hollow particles.

11. The method of claim 7, further comprising forming a protective layer on said thermal recording layer.

12. The method of claim 7, further comprising forming an additional back coat layer on a side of said support opposite the side having the intermediate and thermal recording layers.

* * * * *